US006321762B1

(12) United States Patent
Suyama et al.

(10) Patent No.: US 6,321,762 B1
(45) Date of Patent: Nov. 27, 2001

(54) RACK SUPPORT CONSTRUCTION FOR DISH WASHER

(75) Inventors: Koji Suyama, Ohara-gun; Osamu Okui, Toyoake; Keiichi Toga, Hikawa-gun; Hiroshi Omura, Matsue; Sadamu Kamoto, Ohara-gun, all of (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 09/406,934

(22) Filed: Sep. 28, 1999

(51) Int. Cl.[7] ..... A47L 15/42

(52) U.S. Cl. ..... 134/201; 134/104.1; 134/179; 134/200

(58) Field of Search ..... 134/200, 201, 134/59, 104.1, 176, 179

(56) References Cited

U.S. PATENT DOCUMENTS 4,744,379 * 5/1988 Goettel ..... 134/200 X
4,919,162 * 4/1990 Lumby et al. ..... 134/200 X
5,027,840 * 7/1991 Nezworski ..... 134/200 X
5,131,419 * 7/1992 Roberts ..... 134/200 X

* cited by examiner

*Primary Examiner*—Philip R. Coe
(74) *Attorney, Agent, or Firm*—Koda & Androlia

(57) ABSTRACT

Side extension members and a front extension member, which extend inwardly horizontally to be bent downward at right angle are provided on side walls and a front wall in a washing tank to be positioned at a level lower by a predetermined distance than a top end of the washing tank. A rack rail is pivotally supported on the side extension members through shaft portions to be made turnable. The rack rail is formed with positioning portions. Restriction members are provided on the front extension member to extend inward corresponding to the positioning portions of the rack rail, and the positioning portions are adapted to be placed on the restriction members.

5 Claims, 12 Drawing Sheets

RACK SUPPORT CONSTRUCTION FOR DISH WASHER

SPECIFICATION

1. Field of the Invention

The present invention relates to a rack support construction for dish washers, and more particularly, to a rack support construction for dish washer, which comprises a rack support member within a washing tank, and washes tableware in a state, in which a dish rack receiving the tableware is placed on the rack support member.

2. Description of the Related Art

Dish washers for automatically washing tableware such as dishes, rice bowls, tea cups, glasses or the like having been used for eating and drinking have been installed at kitchens in teahouses, restaurants or the like and further in common homes to be widely and suitably used. Such dish washers comprise upper and lower rotatable washing nozzles in a washing tank, the nozzles being rotated by jet reaction forces of hot water to efficiently perform washing by blowing the hot water against tableware in a dish rack received in the washing tank.

With the above-described dish washer, a rack rail serving as a rack support member, on which a dish rack is placed, is arranged within the washing tank, and the dish rack placed on the rack rail is positioned between the upper and lower washing nozzles. As shown in, for example, FIG. 19, a rack rail 10 comprises a main body 11 in the form of rectangular-shaped frame composed of elongated sheet members, downwardly inclined leg sections 14 formed on ends of the main body 11 to be spaced from each other in a longitudinal direction and to correspond to right and left inner side walls 13, 13 (only one shown) spaced from each other in the washing tank 12 in a widthwise direction, and latch sections 15 provided on the ends of the respective leg sections 14 to be bent vertically. As shown in FIGS. 19 and 20, the respective latch sections 15 are inserted into through holes 16*a*, which are arranged in corresponding positions on the inner side walls 13, 13, from above, whereby the rack rail 10 is mounted to the washing tank 12 with the main body 11 in horizontal position.

With the above-described dish washer, the rack rail 10 must be dismounted from the washing tank 12 to be placed outside when an interior of the washing tank 12 should be cleaned periodically or the washing nozzles should be inspected. More specifically, this case involves a difficulty that it is troublesome to find a location, at which the rack rail 10 is placed, in a small spot such as kitchens and the like, and the rack rail occupies a good deal of space, and that the rack rail 10 becomes soiled and unsanitary while it is placed outside the dish washer. Further, there is pointed out such a defect that operations of mounting and dismounting of the rack rail 10 are complicated to take much time for cleaning, inspection and the like.

SUMMARY OF THE INVENTION

The present invention has been proposed to suitably solve the above-described problems inherent in the prior art, and has its object to provide a rack support construction for dish washers, which makes it possible to simply perform cleaning and inspecting an interior of a washing tank.

To solve the above-described problems and to suitably attain an intended object, the present invention provides a rack support construction in a dish washer for washing tableware received in a dish rack contained in a washing tank, the rack support comprising a rack support member, which is pivotally supported in the washing tank to be made turnable, and on which the dish rack can be placed, a positioning portion or portions formed in a region away from a pivot or pivots of the rack support member, and a restriction member or members, which are provided on an inner wall of the washing tank and on which the positioning portions are placed, and wherein the positioning portion or portions of the rack support member are placed on the restriction member or members whereby the rack support member is kept in a horizontal position to enable placing thereon the dish rack, and wherein the rack support member is turned in a direction, in which the positioning portion or portions are spaced away from the restriction member or members whereby an interior of the washing tank can be opened.

DETAILED DESCRIPTION OF THE PREFERRED EMBODIMENTS

Figure 1:
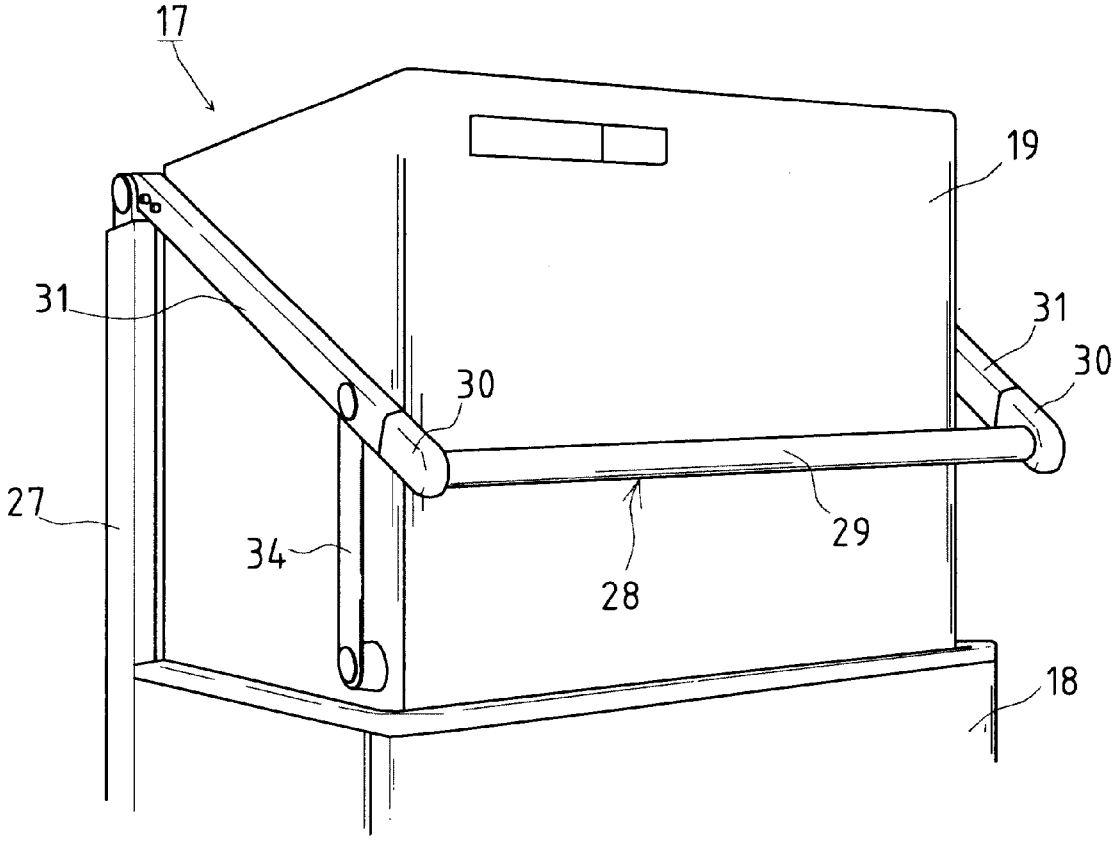
FIG. 1 is a schematic, perspective view showing an essential part of a dish washer according to an embodiment of the present invention.
Figure 2:
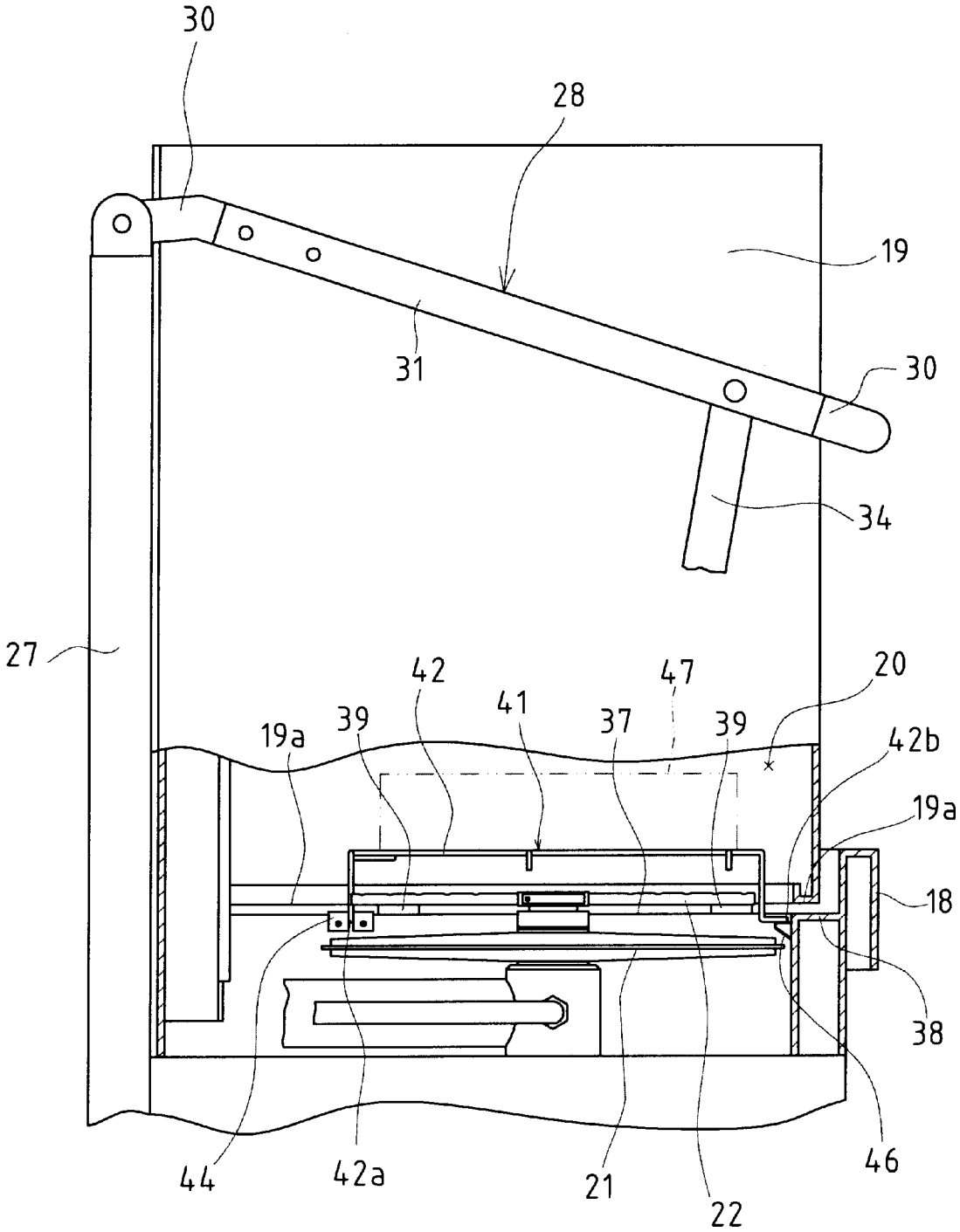
FIG. 2 is a side view showing the dish washer according to the embodiment of the present invention with a part thereof broken.
Figure 3:
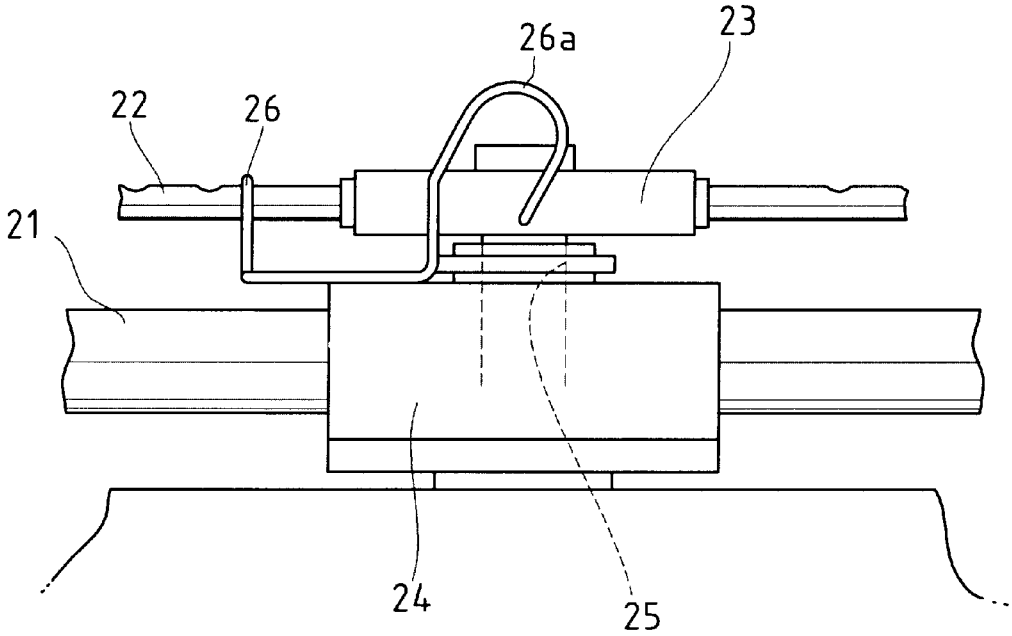
FIG. 3 is a view illustrating a mount construction of a lower rinsing nozzle in the embodiment of the present invention.
Figure 4:
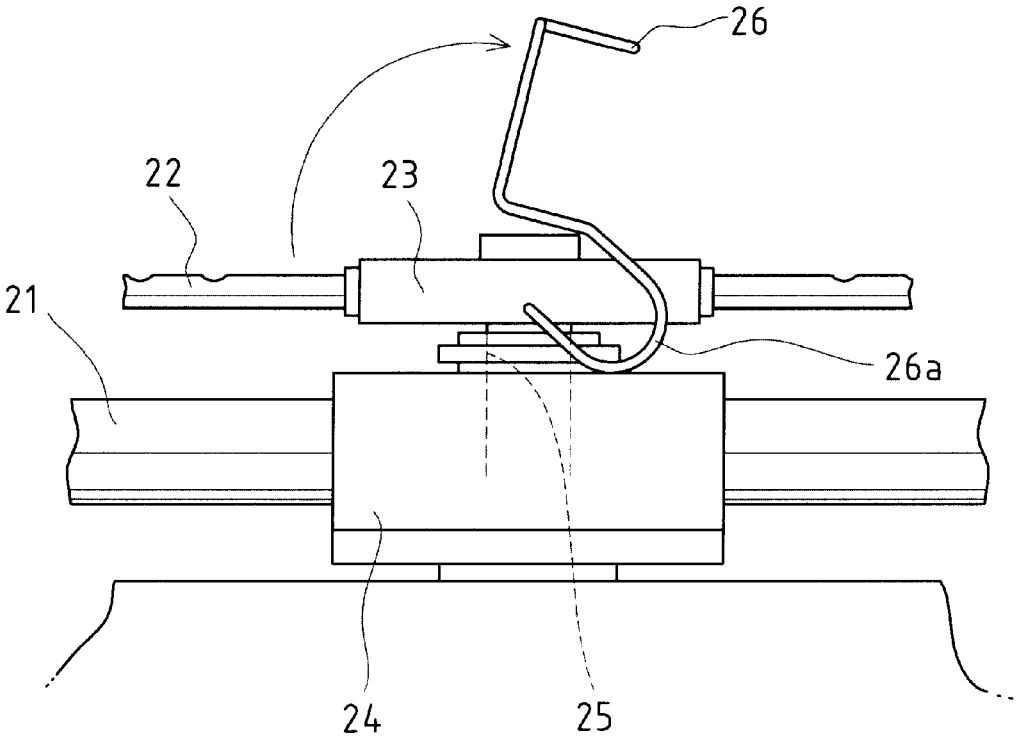
FIG. 4 is a view illustrating a process of dismounting the lower rinsing nozzle in the embodiment of the present invention.
Figure 5:
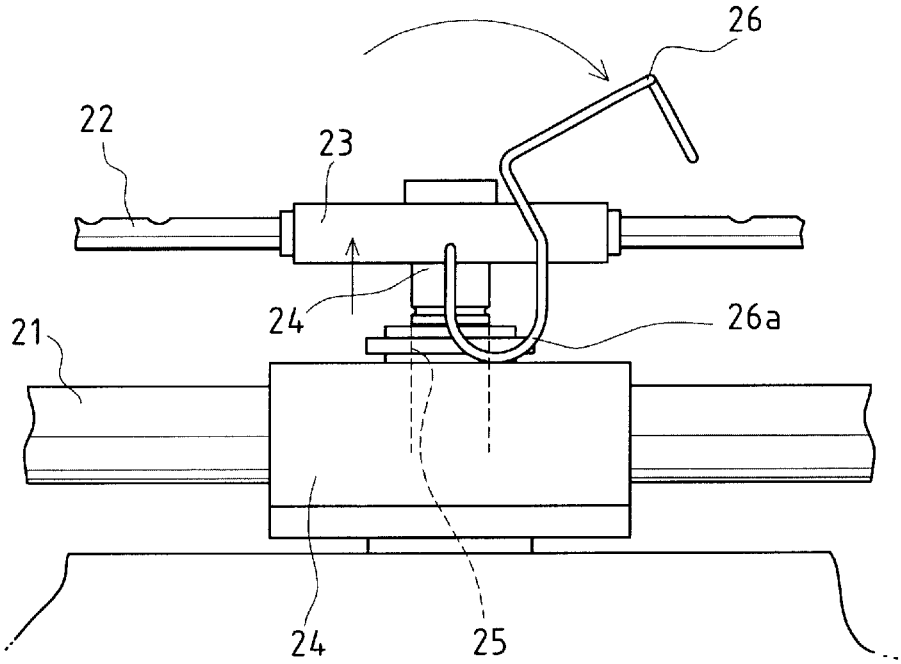
FIG. 5 is a view illustrating a process of dismounting the lower rinsing nozzle in the embodiment of the present invention.
Figure 6:
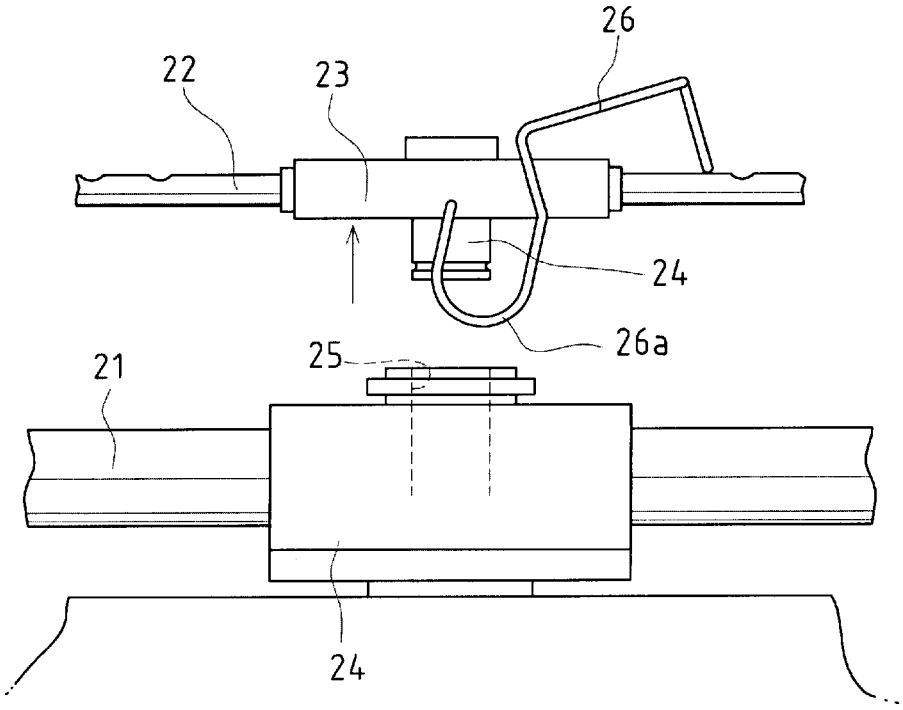
FIG. 6 is a view illustrating a process of dismounting the lower rinsing nozzle in the embodiment of the present invention.

Next, a rack support construction for dish washers, according to the present invention will be described by way of preferred embodiments with reference to the accompanying drawings. A dish washer 17 shown in FIG. 1 essentially comprises a rectangular parallelepiped washing tank 18 opened fully at a top thereof and a casing-shaped cover 19 capable of covering the washing tank 18 from above and moving up and down, the cover 19 defining therein a washing chamber 20 in a state, in which it covers the washing tank 18. As shown in FIG. 2, pivotally mounted to be horizontally rotatable are a lower washing nozzle 21 adapted to be rotated by jet reaction forces of a hot water pressure fed from a hot water supply source (not shown), and a lower rinsing nozzle 22 for supplying a rinsing water after tableware is washed. Further, pivotally mounted through horizontal arms at upper positions facing the lower washing nozzle 21 and the lower rinsing nozzle 22 are an upper washing nozzle and an upper rinsing nozzle, which are not shown and serve as the same functions as those of the lower washing nozzle and the lower rinsing nozzle.

In addition, the above-described rinsing nozzle 22 is detachably mounted to a nozzle mount section 57 through a holder 23, as shown in FIGS. 3 to 6. The holder 23 comprises a fitting cylinder section 24 extending downward, and is mounted by fitting the fitting cylinder section 24 into a mount hole 25, which is formed on the nozzle mount section 57 and is provided with a ball-latch construction. Also, an operating lever 26 is turnably mounted on the holder 23 and is formed with an operating portion 26*1*, which is caused to protrude downward from the holder 23 when the operating lever 26 is turned. More specifically, turning of the operating lever 26 in a predetermined direction (clockwise direction in FIG. 3) causes the operating portion 26*a* to abut against a top surface of the nozzle mount section 57 to push the holder 23 upward, thereby enabling simply pulling the fitting cylinder section 24 out from the mount hole 25.

A rear frame 27 composed of a pair of struts spaced from each other in a widthwise direction and a panel provided between the both struts is arranged on a back surface of the washing tank 18 and the casing-shaped cover 19 is supported to be capable of moving up and down along a guide member (not shown) provided on the rear frame 27. Also, smooth opening and closing movement of the casing-shaped cover 19 relative to the washing tank 18 are caused by a lifting mechanism (not shown) composed of a combination of an arm, a link, a spring and so on, which are provided on the rear frame 27, and the casing-shaped cover 19 is adapted to be moved up and down simply by a handle 28, which is C-shaped in plan to surround the casing-shaped cover 19, as shown in FIG. 1.

Figure 7:
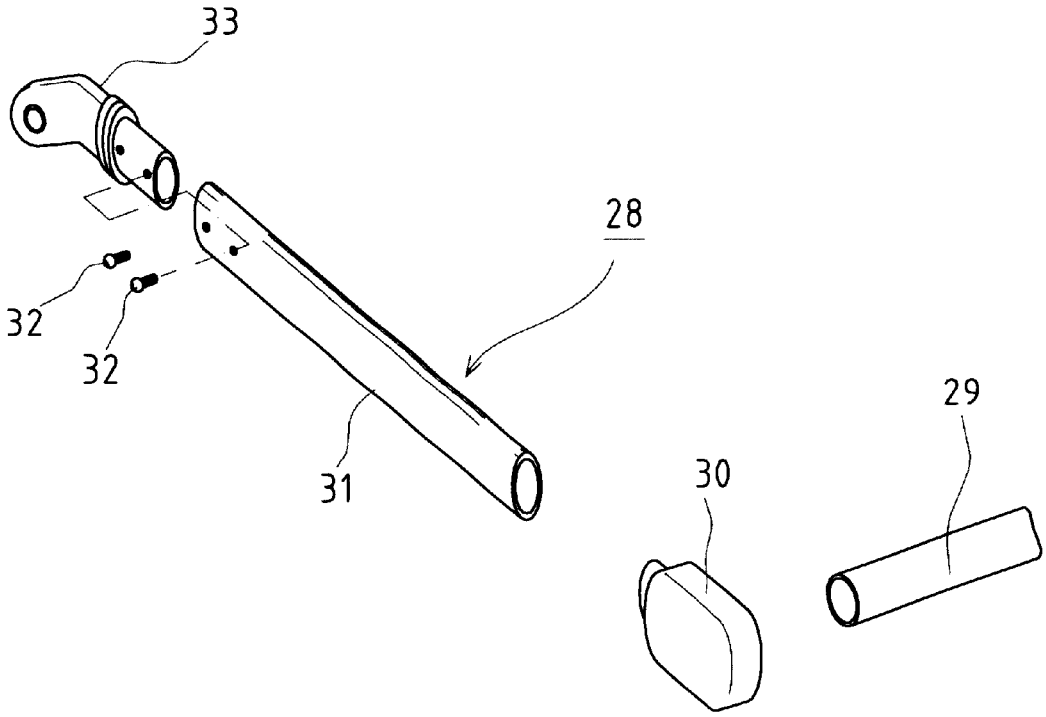
FIG. 7 is a schematic, perspective exploded view showing a handle for vertically moving a casing-shaped cover up and down in the embodiment of the present invention.

The handle 28 comprises, as shown in FIG. 7, an operating portion 29 having a circular-shaped cross section and facing a front surface of the casing-shaped cover 19, side rods 31, 31 having a substantially elliptical-shaped cross section and connected to both ends of the operating portion 29 through connection members 30, 30, and dog-legged pivots 33 detachably mounted to rear ends of the respective side rods 31 by screws 32, the both pivots 33, 33 being pivotally supported by the rear frame 27. Also, pivotally mounted to the respective side rods 31 on the handle 28 are one ends of link rods 34, which are pivotally mounted at the other ends thereof to opposite side plates of the casing-shaped cover 19, whereby the casing-shaped cover 19 is moved up and down as the handle 28 is turned vertically.

Figure 8:
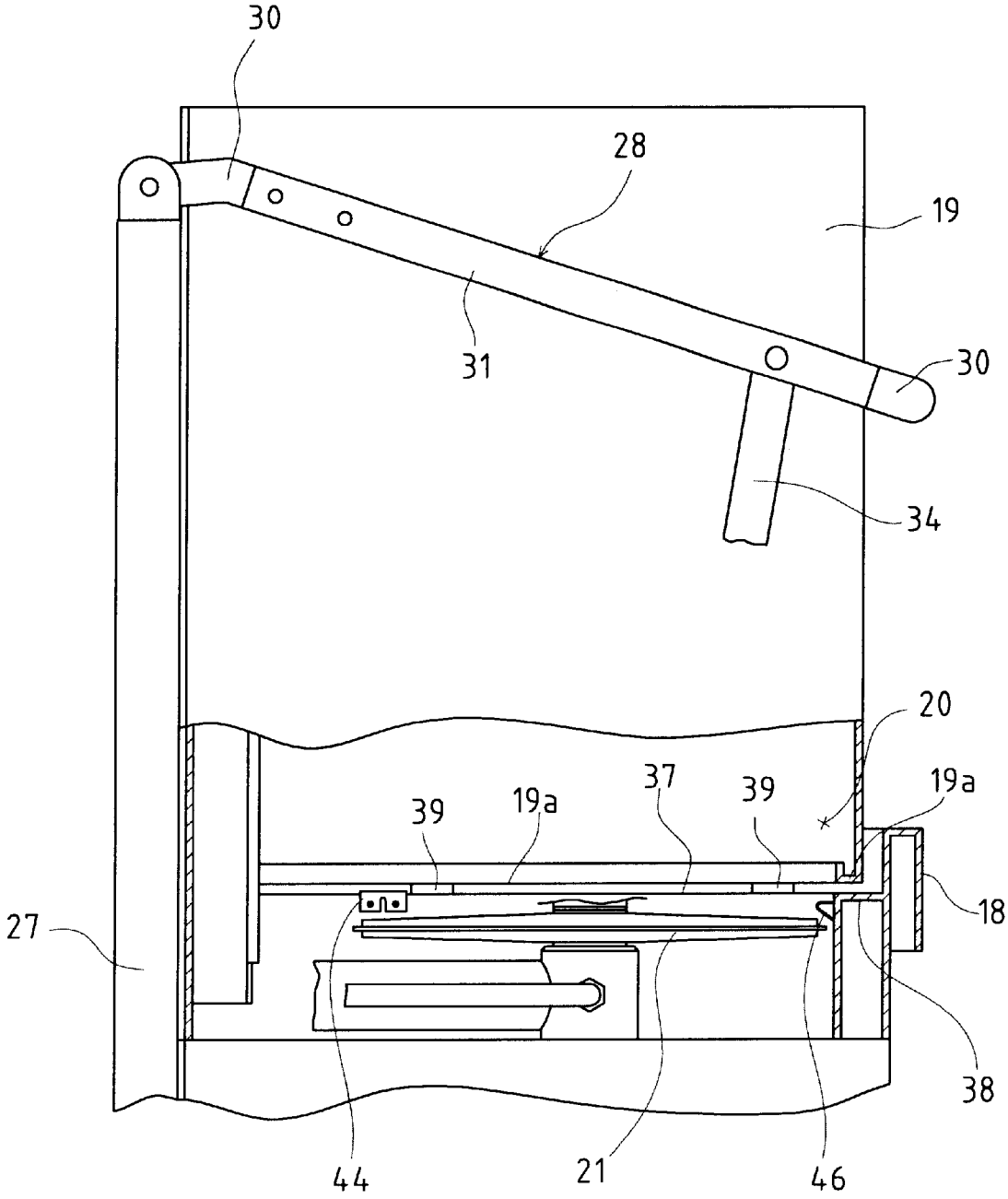
FIG. 8 is a partially fragmentary side view showing a state, in which the casing-shaped cover in the embodiment of the present invention abuts against elastic bodies.
Figure 9:
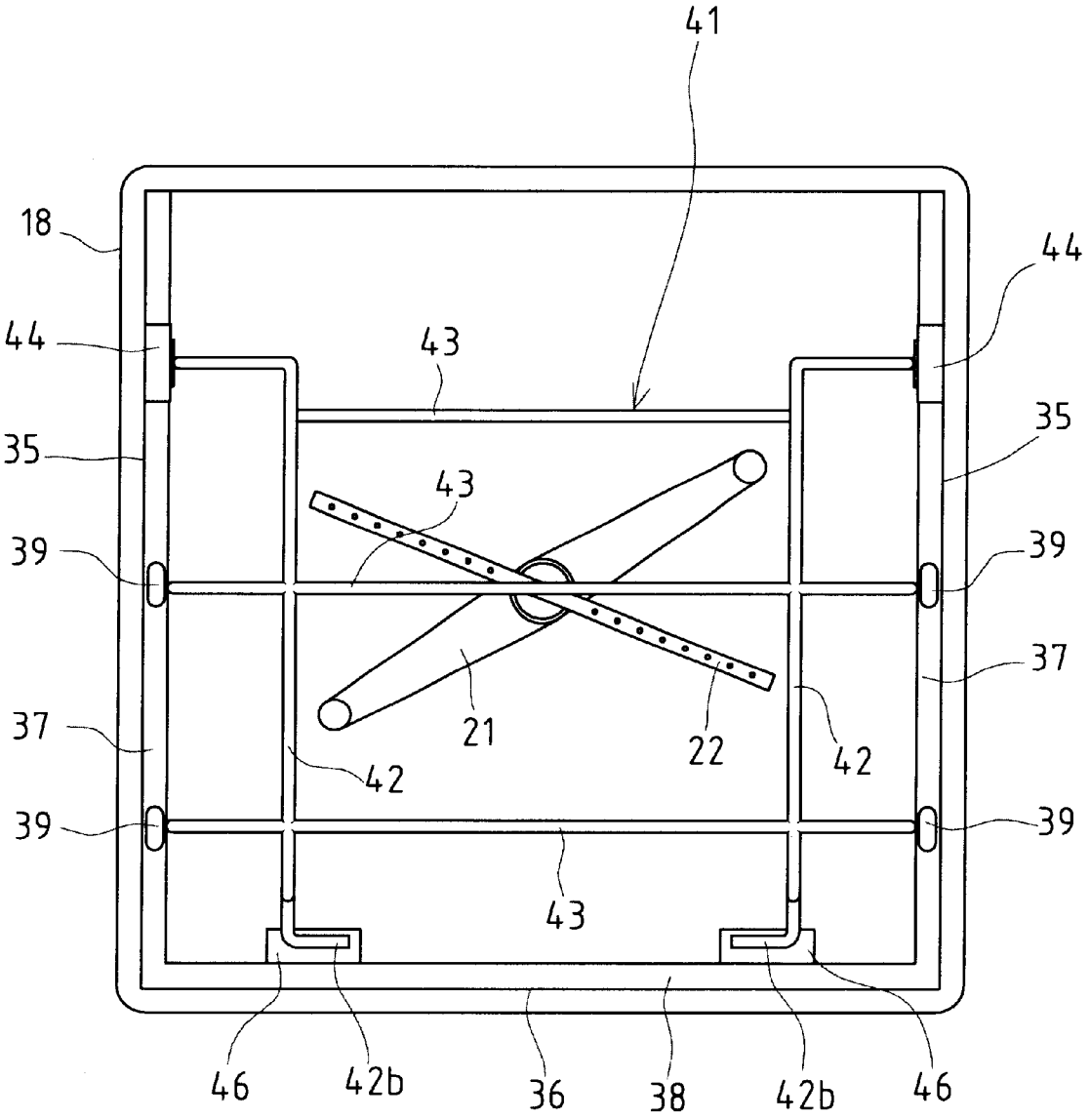
FIG. 9 is a schematic, plan view showing a washing tank in the embodiment.

Extension members 37, 37, 38 extending inwardly and horizontally to be bent downward at right angles are provided on right and left side walls 35, 35 in a widthwise direction and on a front wall 36 on a front side within the washing tank 18 to be positioned at a level lower than a top end of the washing tank 18 by a predetermined distance. Further, arranged on upper surfaces of the right and left extension members 37, 37, as shown in FIG. 9, are a plurality (two in the embodiment) of elastic bodies 39 spaced from each other in a longitudinal direction such that inwardly extending lower end edges 19*a* of the casing-shaped cover 19, which covers the washing tank 18, are adapted to abut against the elastic bodies 39 (see FIG. 8). More specifically, with the lower end edges 19*a* of the casing-shaped cover 19 abutting against the elastic bodies 39, gaps between the lower end edges 19*a* and the extension members 37, 37, 38 are small to enable preventing scattering of washing water and rinsing water to the outside. Also, the elastic bodies 39 makes the gaps uniform in magnitude to enable suppressing sidewise swinging of the casing-shaped cover 19.

Figure 10:
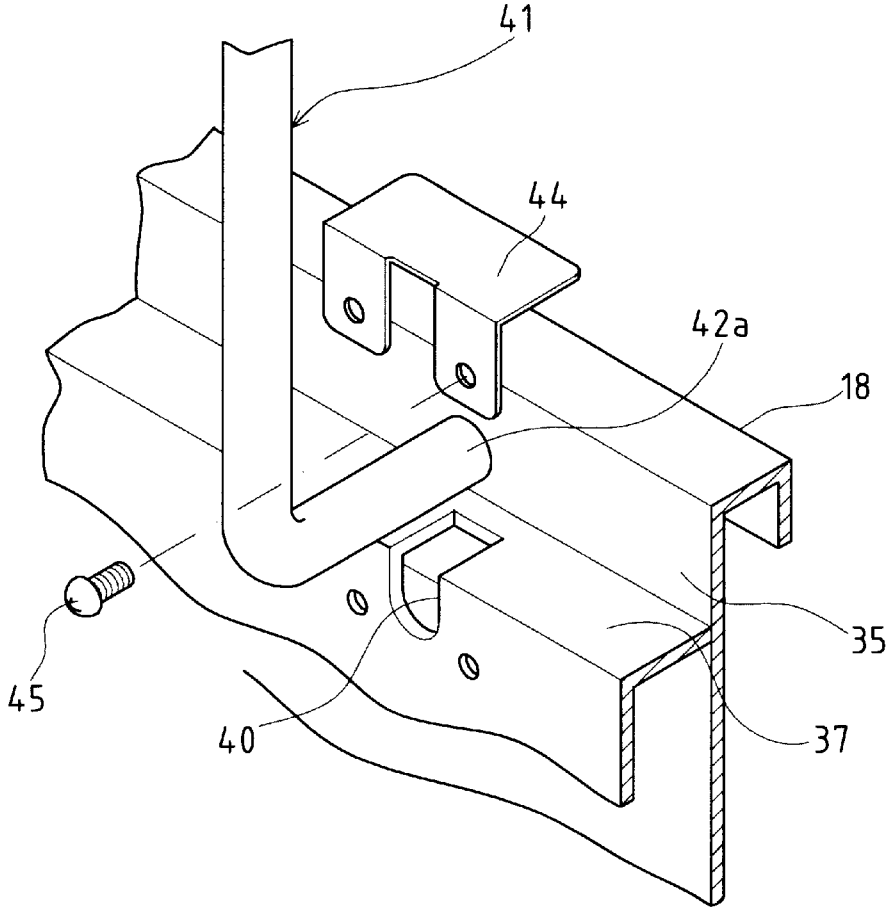
FIG. 10 is a schematic, perspective exploded view showing a pivot section for pivotally mounting a rack rail to the washing tank in the embodiment.
Figure 11:
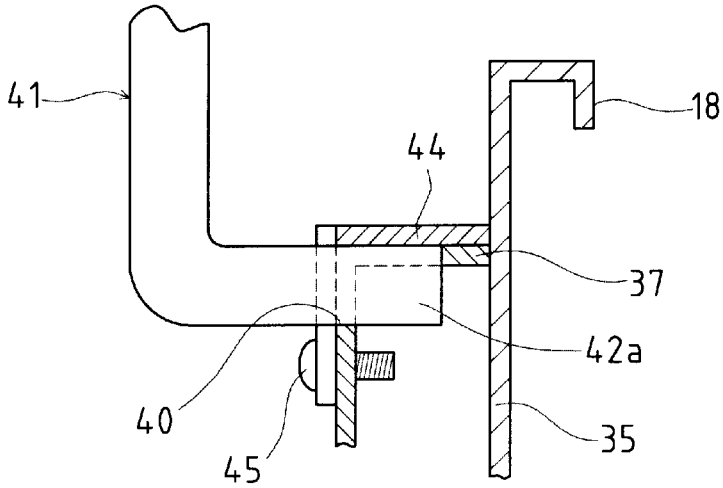
FIG. 11 is a cross sectional view showing an essential part of the pivot section for pivotally mounting a rack rail to the washing tank in the embodiment.

Formed at rearward portions of the extension members 37, 37 provided on the side walls 35, 35 of the washing tank 18 are notches 40, 40, respectively, at which the extension members are broken over upper surfaces and inner surfaces thereof, and pivotally supported through the right and left facing notches 40, 40 to be made turnable is a rack rail 41 serving as a rack supporting member, on which a dish rack 47 can be placed. More specifically, the rack rail 41 comprises, as shown in FIG. 9, a pair of longitudinal rods 42, 42 formed of a rod material such as round bar, round pipe or the like and extending longitudinally and spaced from each other in a widthwise direction, and a plurality of lateral rods 43 formed of a rod material similar to that of the longitudinal rods are arranged between the both longitudinal rods 42, 42 and spaced from each other in the longitudinal direction. Further, formed on rear ends of the respective longitudinal rods 42 are horizontal shaft portions 42*a*, which are bent downward at right angle and then bent widthwise outward at right angle, the right and left shaft portions 42*a*, 42*a* being adapted to engage with the notches 40, 40 of the extension members 37, 37 from above. In addition, presser plates 44 adapted to cover the notches 40 from above for prevention of detachment of the shaft portions 42*a* are detachably arranged, as shown in FIGS. 10 and 11, by screws 45 at positions where the notches 40 of the extension members 37 are formed.

Formed on front ends of the respective longitudinal rods 42 on the rack rail 41 are horizontal positioning portions 42*b*, which are bent downward at right angle and then bent widthwise inward at right angle. Also, arranged on an inner surface of the front extension member 38 provided on the front wall 36 of the washing tank 18 to extend inward are restriction members 46, 46 disposed to correspond to the right and left positioning portions 42*b*, 42*b* of the rack rail 41, as shown in FIG. 9, whereby the positioning portions 42*b*, 42*b* are adapted to be placed on the restriction members 46, 46. Thus, the rack rail 41 is made to turn about the shaft portions 42*a*, 42*a* so as to be positioned in a washing position (FIG. 12) where the positioning portions 42*b*, 42*b* are placed on the restriction members 46, 46 and in a retracted position (FIG. 13) where the positioning portions 42*b*, 42*b* are separated from the restriction members 46, 46 to permit the longitudinal rods 42 to rise substantially vertically on the back side of the washing tank 18. In addition, the respective longitudinal rods 42 and lateral rods 43 are kept horizontal in the washing position to make it possible to place the dish rack 47 thereon. Also, a level of top surfaces of the respective longitudinal rods 42 and lateral rods 43 in the washing position is set to be substantially equal to a level of the top end of the washing tank 18 to enable easily bringing in the dish rack 47 from outside.

(Action of the Embodiment)

Figure 12:
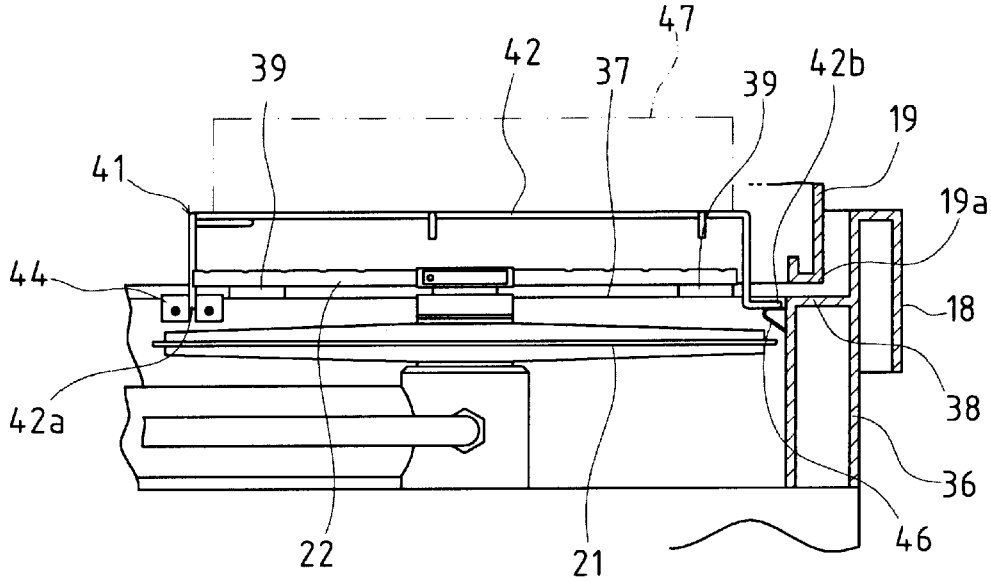
FIG. 12 is a side view showing a state, in which the rack rail in the embodiment is kept in a washing position.

An action of a rack support construction for dish washers, according to the embodiment will be described hereinafter. As shown in FIG. 1, when the casing-shaped cover 19 having covered the washing tank 18 is to be opened, an operator puts hand on the operating portion 29 of the handle 28 to turn the handle 28 upward so as to move the casing-shaped cover 19 up, and then the casing-shaped cover 19 is moved up along the guide member to open the washing tank 18. Since the positioning portions 42*b*, 42*b* are made in the washing position to be placed on the restriction members 46, 46 as shown in FIGS. 2 and 12, the rack rail 41 arranged in the washing tank 18 can place horizontally thereon the dish rack 47, which receives therein tableware (not shown).

The handle 28 is turned downward to have the casing-shaped cover 19 descending and covering the washing tank 18 from above, thus having the casing-shaped cover surrounding the dish rack 47 placed on the rack rail 41.

Upon the covering of the washing tank 18 by the casing-shaped cover 19, washing is started in the dish washer 17, and thus the washing liquid from the upper and lower washing nozzles 21 is jetted against and fed toward the tableware and the rinsing water is fed from the upper and lower rinsing nozzles 22 after the washing. At this time, because the lower end edges 19*a* of the casing-shaped cover 19 are positioned below the top end of the washing tank 18 and abut against the elastic bodies 39 on the respective extension members 37, 37, gaps between the lower end edges 19*a* and the extension members 37, 37, 38 are maintained small and constant. Accordingly, it is possible to suitably prevent the washing liquid and the rinsing water from scattering outside from between the washing tank 18 and the casing-shaped cover 19. Also, the elastic bodies 39 can prevent sidewise swinging of the casing-shaped cover 19. In addition, formation of the gaps between the lower end edges 19*a* of the casing-shaped cover 19 and the respective extension members 37, 37, 38 permits pressures to leak through the gaps even when inner pressures in the washing chamber 20 rise at the start of washing, thus eliminating disadvantages that the casing-shaped cover 19 lifts.

Upon the completion of washing and rinsing of the tableware after the lapse of a predetermined period of time, the handle 28 is operated to move the casing-shaped cover 19 up to open the washing tank 18 and the dish rack 47 is taken out to complete washing of the tableware. In addition, the operating portion 29 of the handle 28 is circular in cross section and has a suitable thickness, so that a favorable feeling of operation is obtained. Further, because the side rods 31, 31 on the handle 28 have a substantially elliptical-shaped cross section, they can ensure an adequate strength while being limited to a small widthwise dimension.

Figure 13:
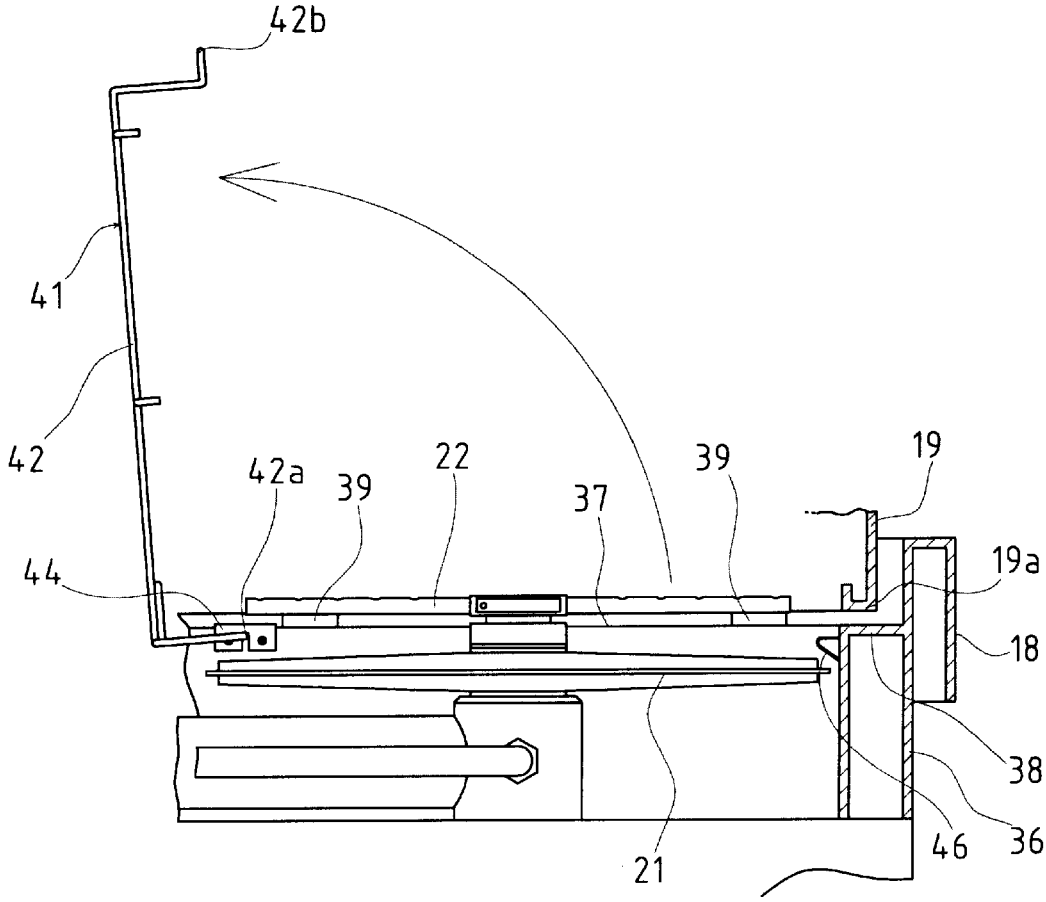
FIG. 13 is a side view showing a state, in which the rack rail in the embodiment is kept in a retracted position.

In the case of cleaning an interior of the washing tank 18 and inspecting the lower washing nozzle 21 or the lower rinsing nozzle 22, the interior of the washing tank 18 is opened by rearward turning the rack rail 41 about the shaft portions 42*a*, 42*a* to make the same in the retracted position, as shown in FIG. 13. Therefore, it is possible to easily perform cleaning of the interior of the washing tank 18 and inspection of the lower washing nozzle 21 or the lower rinsing nozzle 22. Besides, since it is unnecessary to take out the rack rail 41 from the washing tank 18 and place the same outside, there is no need of finding a place where the rack rail 41 is to be placed, and of ensuring such space. Also, because the rack rail 41 is free from becoming soiled, it is hygienic.

Here, when the lower rinsing nozzle 22 is to be removed while the rack rail 41 is kept in the retracted position, the operating lever 26 is turned in the clockwise direction as shown in FIGS. 3 to 6. Thus the operating portion 26*a* of the operating lever 26 is caused to abut against the top surface of the nozzle mount section 57 to push the holder 23 upward, thereby enabling simply pulling the fitting cylinder section 24 out from the mount hole 25. In this manner, the principle of leverage by means of the operating lever 26 is used to remove the lower rinsing nozzle 22, so that the nozzle can be removed with a force of small magnitude. Also, although the rinsing nozzle 22 is made high in temperature immediately after the rinsing with the hot water, the operating lever 26 becomes cold in a short time because of its small thickness, so that it is possible to manipulate the lever without passing away much time. In addition, to mount the rinsing nozzle 22 on the nozzle mount section 57, it suffices only to fit the fitting cylinder section 24 into the mount hole 25 with the operating lever 26 returned to the original position (position shown in FIG. 3). In this manner, inspection of and cleaning of the lower rinsing nozzle 22 are made easy since mounting and dismounting of the nozzle can be simply performed in a short time. Further, the rinsing nozzle 22 in the embodiment is made lightweight as compared with that of the prior art, which is detachably fixed by means of attaching bolts or the like.

The rack rail 41 can be kept in a horizontal, washing position as shown in FIG. 12 only by turning the rack rail 41 forward and placing the positioning portions 42*b*, 42*b* on the restriction members 46, 46 after the completion of cleaning of the washing tank 18 and inspection of the lower washing nozzle 21 or the lower rinsing nozzle 22. Thus the operations of cleaning the washing tank 18 and inspecting the nozzles 21, 22 can be simply performed in a short time because it suffices to turn the rack rail 41. In addition, because the rack rail 41 in the embodiment is formed of a rod material, the washing liquid jetted from the washing nozzle 21 and the rinsing water jetted from the rinsing nozzle 22 are made to efficiently strike against the tableware to enhance the washing capacity. Also, the operator can safely deal with the rack rail 41 when turning the same. Further, exchange of the rack rail 41, maintenance of the lifting mechanism for the casing-shaped cover 19 and so on can be easily performed because it is possible to simply remove the rack rail 41 itself from the washing tank 18 by dismounting the presser plates 44 from the extension members 37.

(Modification Examples)

The present invention is not limited to the above-described embodiment, but the following modification examples can be suitably employed.

Figure 14:
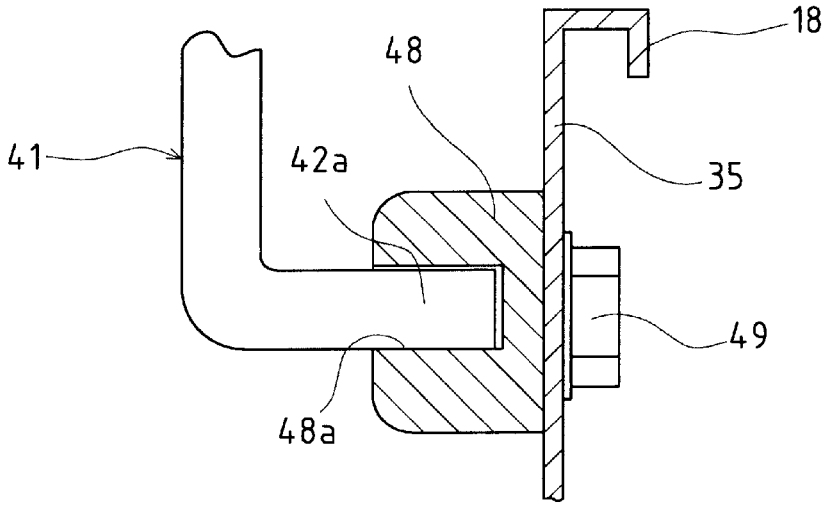
FIG. 14 is a cross sectional view showing a modification of a pivot section for the rack rail.

FIG. 14 shows a modification example, by which the rack rail 41 is pivotally mounted to the washing tank 18. Block bodies 48 formed with inwardly opened holes 48*a* are detachably fixed to the side walls 35 of the washing tank 18 by means of bolts 49, which are threaded from outside of the side walls 35. The shaft portions 42*a* of the rack rail 41 are inserted into the holes 48*a* of the block bodies 48 to turnably support the rack rail 41 in pivotal fashion. With the arrangement, the rack rail 41 is mounted on the washing tank 18 by fixing the both block bodies 48, 48 to the corresponding side walls 35 through the bolts 49, 49 while the block bodies 48, 48 are beforehand mounted to the both shaft portions 42*a* of the rack rail 41.

Figure 15:
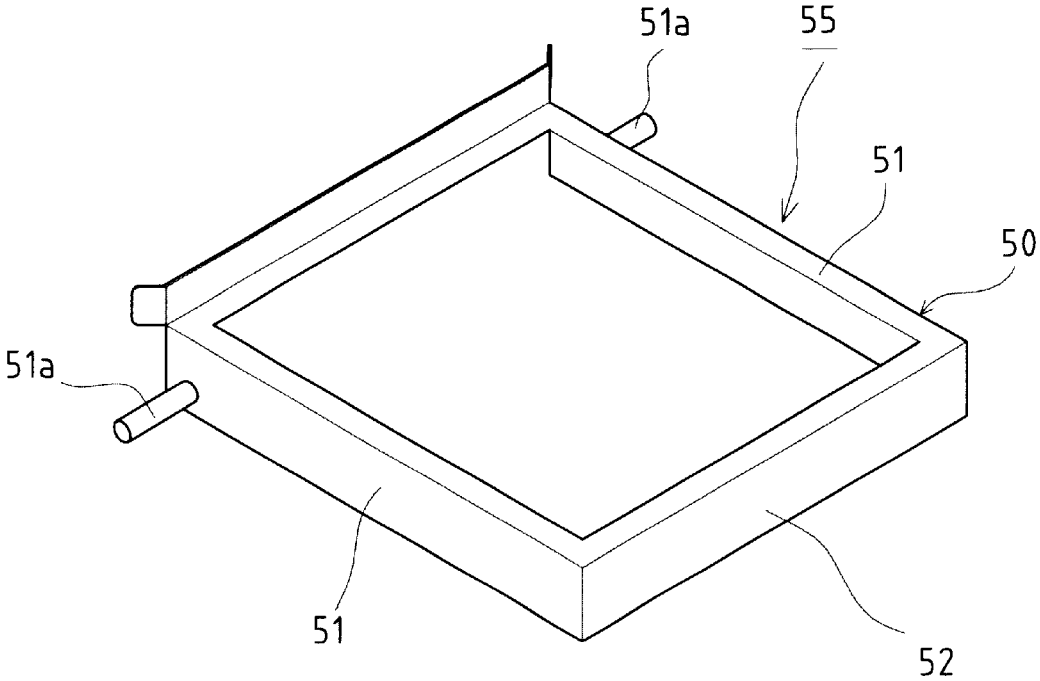
FIG. 15 is a schematic, perspective view showing a modification of a rack rail.

FIG. 15 shows a modification of a rack rail itself. A sheet material is arranged in the form of a rectangular-shaped frame to provide a body 50, and both side plates 51, 51 are provided at rear sides thereof with shaft portions 51*a*, 51*a*. With a rack rail 55 constructed in the above manner, a lower end of a front plate 52 on the body 50 functions as a positioning portion adapted to be placed on the restriction members 46, 46 of the front extension member 38. In addition, either of the constructions shown in FIG. 10 or FIG. 14 can be employed as a construction for pivotal mounting of the rack rail 55.

Figure 16:
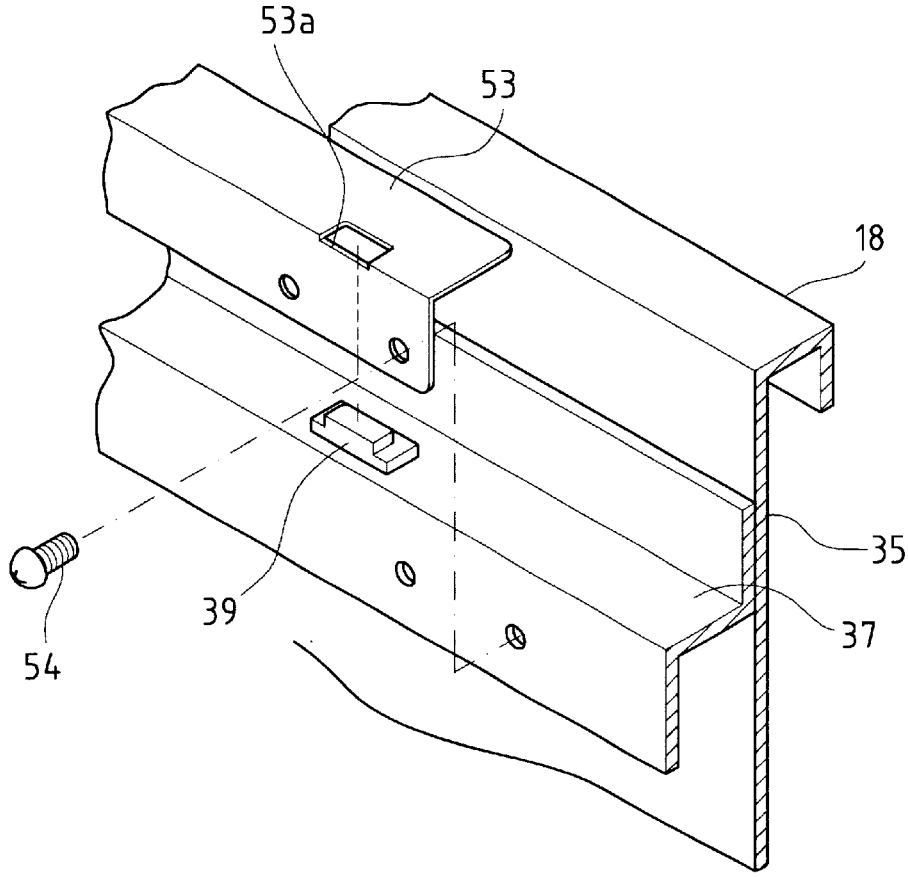
FIG. 16 is a schematic, perspective view showing another example of a mount construction of elastic bodies.

FIG. 16 shows another example of a mount construction of the elastic bodies 39. L-shaped mount plates 53 are detachably provided on the extension members 37 mounted on the side walls 35 of the washing tank 18, by screws 54. The L-shaped mount plates 53 are formed with a plurality of through holes 53*a*, which are spaced from each other in the longitudinal direction and to which the elastic bodies 39 are detachably mounted from below with portions of the elastic bodies 39 projecting above the through holes 53*a*. Thus, with this arrangement, the elastic bodies 39, when deteriorated, can be simply exchanged by dismounting the mount plates 53 from the side extension members 37.

Figure 17:
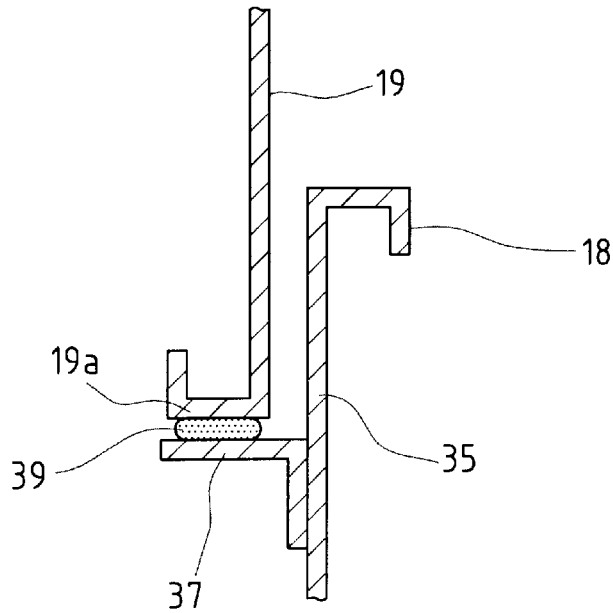
FIG. 17 is a cross sectional view showing a modification of a sidewise extending member disposed in an area where the elastic body is arranged.
Figure 19:
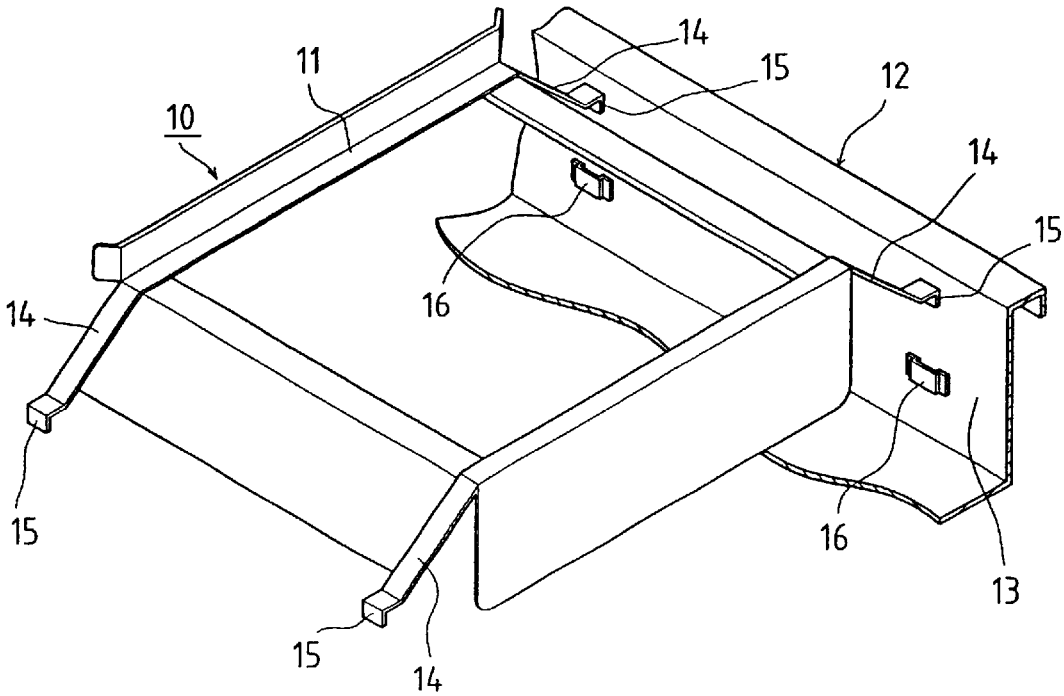
FIG.19 PRIOR ART
FIG. 19 is a schematic, perspective view showing a construction, in which a rack rail in the prior art is arranged on a washing tank.
Figure 20:
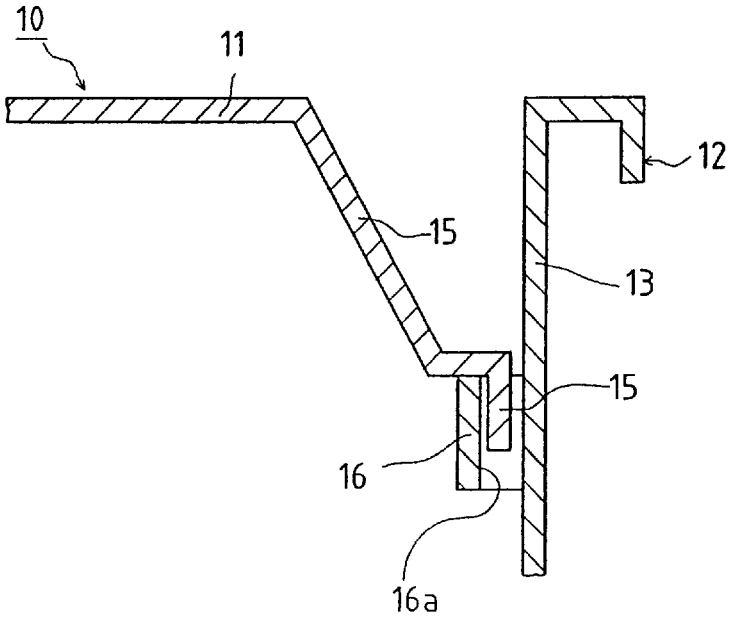
FIG.20 PRIOR ART
FIG. 20 is a cross sectional view showing an essential part of the construction, in which the rack rail in the prior art is arranged on a washing tank.

Further, the side extension members 37 shown in FIG. 9 may be configured such that portions thereof, on which the elastic bodies 39 are arranged, are L-shaped as shown in FIG. 17.

Figure 18:
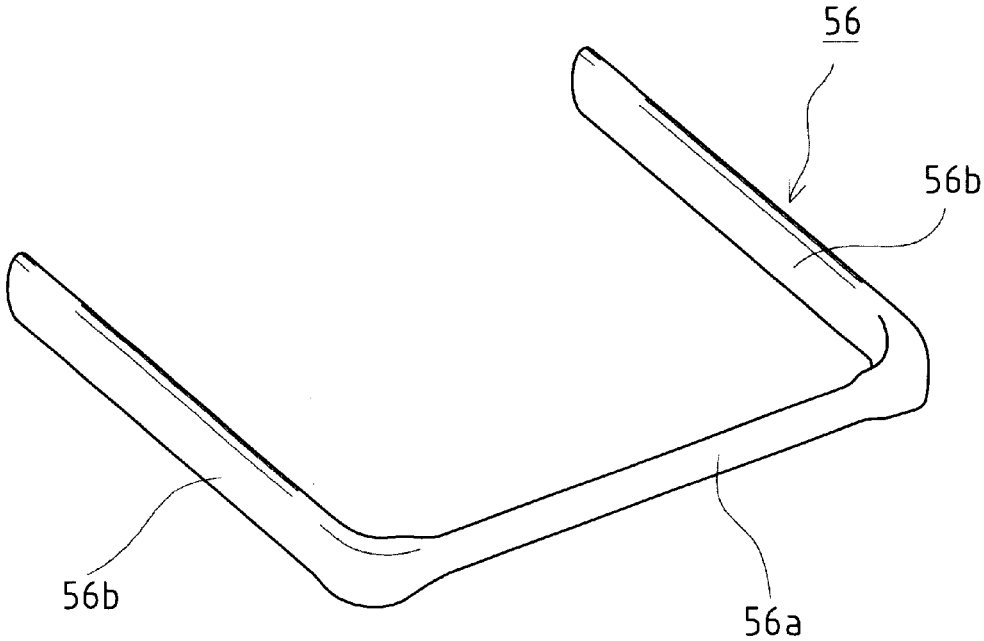
FIG. 18 is a schematic, perspective view showing another example of a handle.

FIG. 18 shows another example of a handle. The handle 56 is formed by bending a single pipe into C-shaped configuration in plane, and comprises a front operating portion 56*a* having a circular-shaped cross section and both side rods 56*b*, 56*b* having a substantially elliptical-shaped cross section.

In addition, while the embodiments, in which the rack rail is made to turn in the longitudinal direction, have been described, the rack rail may be turnably mounted on the front and rear walls on the washing tank so as to turn in the right and left direction. Also, the restriction members need not be provided in plural as in the above-described embodiments, but a single restriction member may be provided over a predetermined length on the front wall. Further, the extension members provided on the front wall or the side walls can be made to serve as such restriction members.

While the embodiments have been described with respect to the dish washer of that type, in which the casing-shaped cover is provided to cover the washing tank from above in such a manner as to make the same vertically movable, and is raised a predetermined distance to open the washing tank, the present invention is not limited thereto. For example, the dish washer may be of that type, in which a door is hingedly connected to an opening at a front face or at a side surface of a washing tank to be capable of turning, and is turned this side to open the opening.

As described above, with the rack support construction for dish washers, according to the invention, a rack support member is turnably arranged in a washing tank, and is turned as desired to open the washing tank, thereby enabling simply performing cleaning and inspecting a portion below the rack support member. Further, it is unnecessary to remove the rack support member from the washing tank and to place the same outside, so that there is no need of finding a place where the rack support member is to be placed, and ensuring such space. Also, because the rack support member is free from becoming soiled, it is hygienic.

What is claimed is:

1. A rack support construction in a dish washer for washing tableware received in a dish rack contained in a washing tank, said rack support comprising:

a rack support member, which is pivotally supported in the washing tank to be made turnable by at least one pivot, and on which the dish rack can be placed, at least one positioning portion formed in a region away from said pivot of the rack support member, and at least one restriction member, which is provided on an inner wall of the washing tank and on which the positioning portion is placed, and wherein the positioning portion of the rack support member is placed on the restriction member whereby the rack support member is kept in a horizontal position to enable placing thereon the dish rack, and wherein the rack support member is pivoted in a direction in which the positioning portion is spaced away from the restriction member whereby an interior of the washing tank can be opened.

2. The rack support construction in a dish washer according to claim 1, wherein said rack support member is pivotally mounted in the washing tank through shaft portions provided rearwardly of the rack support member, and can turn between a washing position, in which the positioning portion is placed horizontally on the restriction member and a retracted position, in which the positioning portion is separated from the restriction member to rise substantially vertically.

3. The rack support construction in a dish washer according to claim 1, wherein said rack support member comprises a pair of longitudinal rods extending in a longitudinal direction, and a plurality of lateral rods provided between the both longitudinal rods to be spaced from one another in the longitudinal direction, and wherein the positioning portion is formed by bending portions of the respective longitudinal rods of the rack support member.

4. The rack support construction in a dish washer according to claim 1, wherein said rack support member comprises a rectangular-shaped frame body formed of a sheet material, and a lower end of a front plate on the frame body functions as the positioning portion.

5. The rack support construction in a dish washer according to claim 1, further comprising an extension member provided on a front wall of the washing tank and the positioning portion is adapted to be correspondingly placed on the restriction member, which are provided on an inner surface of the extension member to extend therefrom.

* * * * *